US007538786B2

(12) United States Patent
Hirai

(10) Patent No.: US 7,538,786 B2
(45) Date of Patent: May 26, 2009

(54) PRINTING APPARATUS

(75) Inventor: Yasuyuki Hirai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/842,610

(22) Filed: Aug. 21, 2007

(65) Prior Publication Data

US 2008/0049092 A1 Feb. 28, 2008

(30) Foreign Application Priority Data

Aug. 23, 2006 (JP) ..... 2006-227181

(51) Int. Cl.
*B41J 25/304* (2006.01)

(52) U.S. Cl. ..... 347/220

(58) Field of Classification Search ..... 347/104, 347/105, 197, 198, 218, 220; 400/642, 647.1, 400/649, 660.1
See application file for complete search history.

(56) References Cited

U.S. PATENT DOCUMENTS

| | | | | |
|---|---|---|---|---|
| 6,232,995 | B1 * | 5/2001 | Schartner | 347/220 |
| 6,556,231 | B2 * | 4/2003 | Nishimura | 347/218 |
| 6,986,574 | B2 | 1/2006 | Nojima et al. | 347/104 |
| 2006/0262355 | A1 | 11/2006 | Kurata et al. | 358/305 |

FOREIGN PATENT DOCUMENTS

| | | |
|---|---|---|
| JP | 2004-231389 | 8/2004 |

* cited by examiner

*Primary Examiner*—K. Feggins
(74) *Attorney, Agent, or Firm*—Fitzpatrick, Cella, Harper & Scinto

(57) ABSTRACT

A printing apparatus is provided which has an eject guide capable of guiding print mediums of different thicknesses, that have been transported there, to a nip portion of the eject rollers of the fixed diameters. To this end, the eject guide is pivotally supported at one end thereof on the platen. The eject guide is positioned with the other end engaged with the chassis. In this state, as the platen moves the eject guide pivots.

6 Claims, 15 Drawing Sheets

PRINTING APPARATUS

BACKGROUND OF THE INVENTION

1. Field of the Invention

The present invention relates to a printing apparatus typically used in a printer, a facsimile and a copying machine, and more particularly to a printing apparatus with a guide member that guides a print medium to an eject roller.

2. Description of the Related Art

A printing apparatus that is used as a printer or a printing unit in a copying machine includes, for example, a serial type printing apparatus. The serial type printing apparatus forms an image on a sheetlike print medium such as paper and OHP sheet by gripping and transporting the print medium and scanning a print head over the print medium at a print position opposite a platen arranged on a print medium transport path. The print medium transport method generally employed by such a printing apparatus involves holding the print medium between a pair of rollers and rotating the rollers to feed the print medium. The pair of rollers is provided on both a paper feeding side and a paper discharging side of the printing apparatus. The rotation speeds of the paper feeding side rollers and the paper discharging side rollers are controlled in transporting the print medium.

Since the print position is provided between the paper feeding side rollers and the paper discharging side rollers, when a printing operation is performed, the print medium during an initial stage of printing is gripped by only the paper feeding side rollers. When, as the printing operation proceeds, the print medium comes close to the paper discharging side rollers, it is introduced into a nip portion of the paper discharging side rollers and held there.

Japanese Patent Laid-Open No. 2004-231389 describes the use of an eject guide to guide a print medium, that has been transported near the paper discharging side rollers, into the nip portion of these rollers.

FIG. 15 shows a relation between a conventional eject guide and a pair of rollers.

A paper eject roller 1510 has rollers 1510*a*, 1510*b* of different diameters extending axially (in a front-back direction perpendicular to a plane of the drawing). A print medium transported from a platen 1514 of FIG. 15 is held between the large-diameter roller 1510*a* and paper eject pinch rollers 1511*a*. The eject guide 1512 guides the print medium to a position near the roller 1510*a* and roller 1511*a*.

One end of the eject guide 1512 is pivotally supported on a fulcrum 1513 of the platen 1514, with the other end supported on a circumferential surface of the small-diameter roller 1510*b*. In printing on print mediums of different thicknesses, the position of the platen 1514 is adjusted vertically in FIG. 15 to keep a distance between the print medium on the platen 1514 and the print head optimal. At this time, the eject guide 1512 pivots about the fulcrum 1513 at the first end with the second end supported on the circumferential surface of the small-diameter roller 1510*b*. With this construction, the print medium is always guided to a nip portion between the large-diameter roller 1510*a* and the paper eject pinch rollers 1511*a*.

Installing such an eject guide 1512 in the printing apparatus, however, requires the small-diameter roller 1510*b* to be formed in the paper eject roller 1510 in order to support one end of the eject guide 1512. Considering a sliding contact with the eject guide 1512, the small-diameter roller 1510*b* of the paper eject roller 1510 needs to be formed of such materials as metals having a wear resistance. The large-diameter roller 1510*a*, on the other hand, needs to be formed of rubber and resin materials to secure a wear resistance against the print medium. Requiring the installation of the paper eject roller 1510 of such a complicated construction is detrimental to reducing the size and weight as well as the cost of the printing apparatus.

SUMMARY OF THE INVENTION

It is an object of this invention to provide a printing apparatus with an eject guide capable of guiding print mediums of different thicknesses, that have been transported there, into a nip portion of eject rollers of fixed diameters.

A printing apparatus comprising: a platen to guide a print medium to a position facing a print head; an eject roller held at a predetermined position on a chassis to eject the printed print medium; and an eject guide to guide the print medium from the platen toward the eject roller; wherein the platen is movable in a direction of thickness of the print medium; wherein the eject guide is pivotally supported on the platen and has an engagement portion engageable with the chassis; wherein, with the engagement portion in contact with the chassis, the eject guide pivots as the platen moves.

With this invention, the printing apparatus is provided with an eject guide that has one end thereof pivotally supported at one part of the platen and the other end held in an abutting relation with the chassis and which can pivot as the platen moves. This construction allows print mediums of various thicknesses to be guided with high precision into the nip portion of the eject rollers even if the eject rollers have fixed diameters.

Further features of the present invention will become apparent from the following description of exemplary embodiments (with reference to the attached drawings).

DESCRIPTION OF THE EMBODIMENTS

First Embodiment

Now, referring to the accompanying drawings, a first embodiment of this invention will be described in detail.

(Overall Construction)

Figure 1:
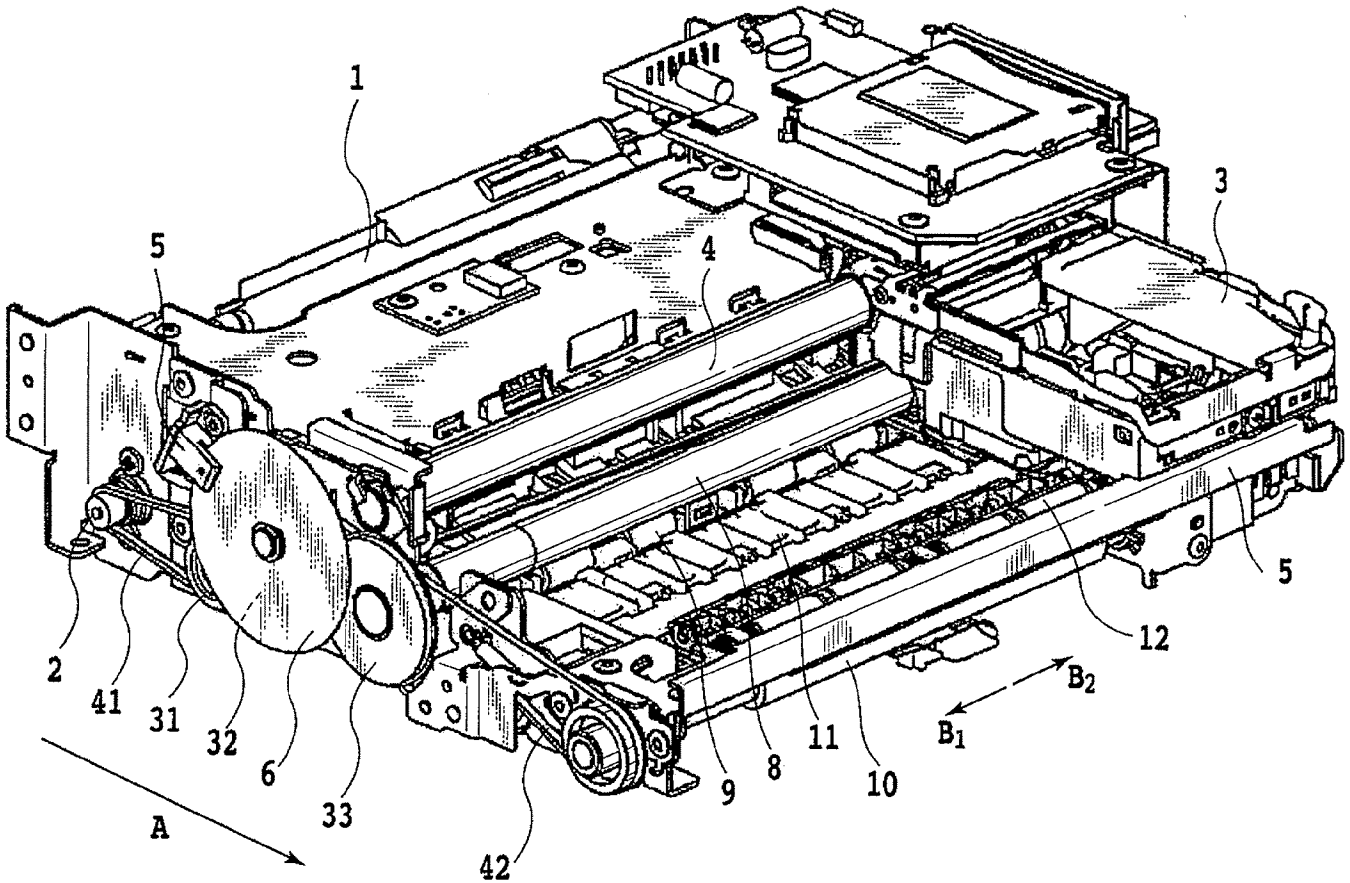
FIG. 1 is a perspective view of a printing apparatus according to a first embodiment of this invention.

FIG. 1 is a perspective view of the printing apparatus of this invention with an enclosure removed to expose an inner construction of the apparatus for explanation. The printing apparatus of this embodiment is a so-called serial type that performs printing by moving a carriage 3 in main scan directions B1, B2 and at the same time ejecting ink from a print head (not shown) mounted in the carriage 3 onto a print medium.

At a supply port 1 there is installed an automatic supply unit that separates one sheet at a time from a stacked print medium and feeds it into the printing apparatus. A transport roller 8 that feeds the print medium has its outer circumferential surface coated with a coating containing ceramic particles. The transport roller 8 has a plurality of transport pinch rollers 9 pressed thereon by springs not shown.

In this printing apparatus, the pressing force of the transport pinch rollers 9 produces a friction between the transport roller 8 and the print medium, and the rotation of the transport roller 8 causes the print medium to move in a subscan direction, a direction of arrow A in FIG. 1. The print medium is guided along the platen 11 until it reaches a print position facing an ink jet print head (hereinafter referred to simply as a print head) where it is temporarily stopped.

The print head can eject ink from a plurality of nozzles and removably mounted in the carriage 3. The carriage 3 is supported on a guide shaft 4 and a guide rail 5 fixed in a chassis 16 so that it can be moved in a main scan direction, a direction of arrows B1 and B2 in FIG. 1, and that it is prevented by the guide rail 5 from pivoting about the guide shaft 4. The carriage 3 is guided along the guide shaft 4 and the guide rail 5 and driven in the main scan direction by a carriage motor (not shown).

The printing apparatus prints one line of image on a print medium by ejecting ink from the print head according to a print signal while moving the carriage 3 along with the print head. Then, the transport roller 8 is rotated to feed the print medium a predetermined distance, after which the printing apparatus again prints the next line of image on the print medium according to the print signal. This sequence of operation is repeated to continue printing on the print medium. The print medium that has gone through the printing operation is gripped between the eject roller 10 and the eject pinch rollers 12 and fed out of the printing apparatus as the eject roller 10 rotates.

The transport roller 8 and the eject roller 10 are driven by a transport motor 2 through gears 31, 32 (situated at the back of an encoder 6), 33 and belts 41, 42. The gear 32 connected to the transport roller 8 and the eject roller 10 is fitted with a rotary encoder 6 that detects the amount of rotation of the rollers. An encoder sensor 5 reads slits of the rotary encoder 6 to rotate the transport roller 8 and the eject roller 10 a predetermined amount.

Figure 2:
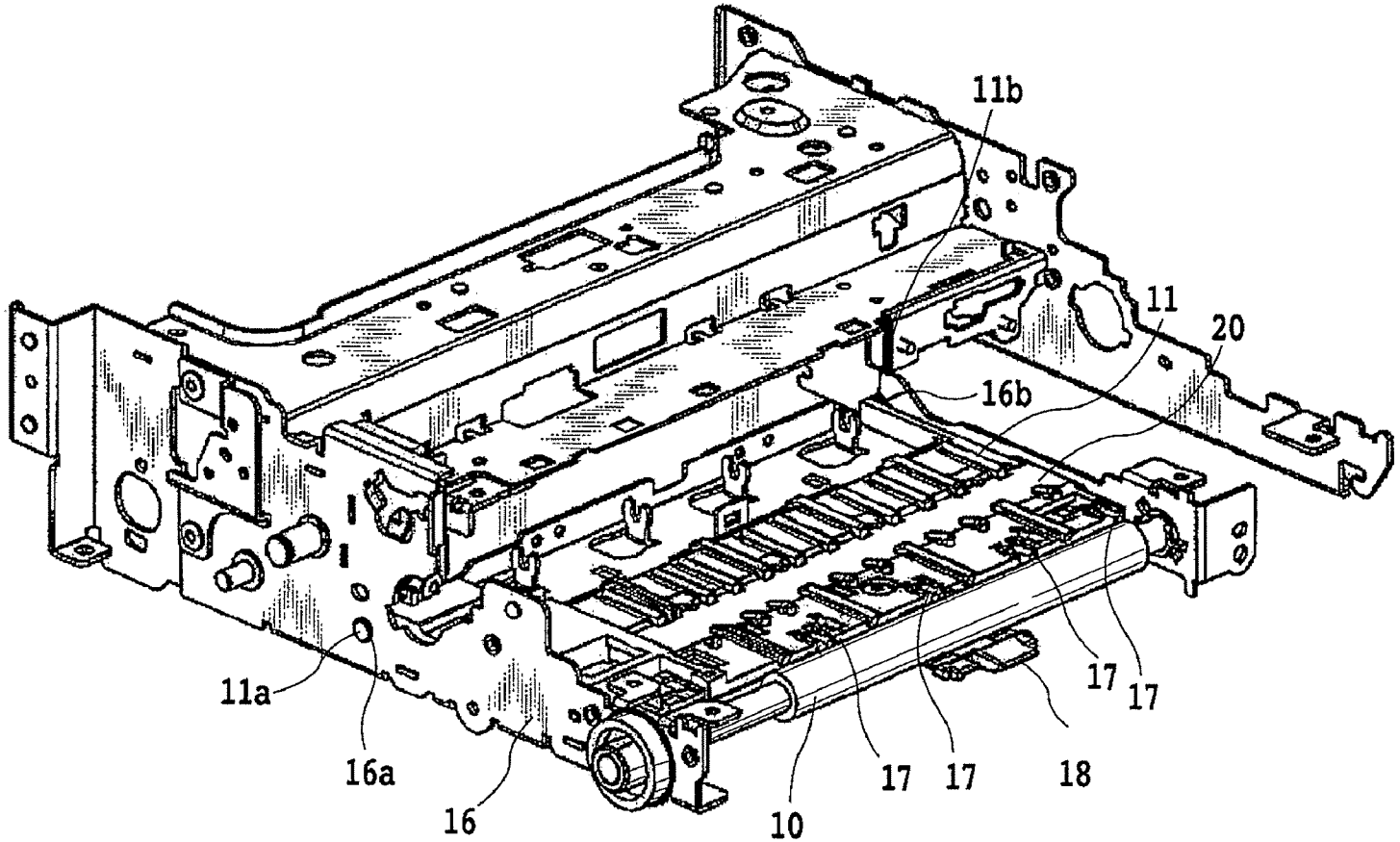
FIG. 2 is a perspective view showing a print medium eject unit and its associated portions.
Figure 3:
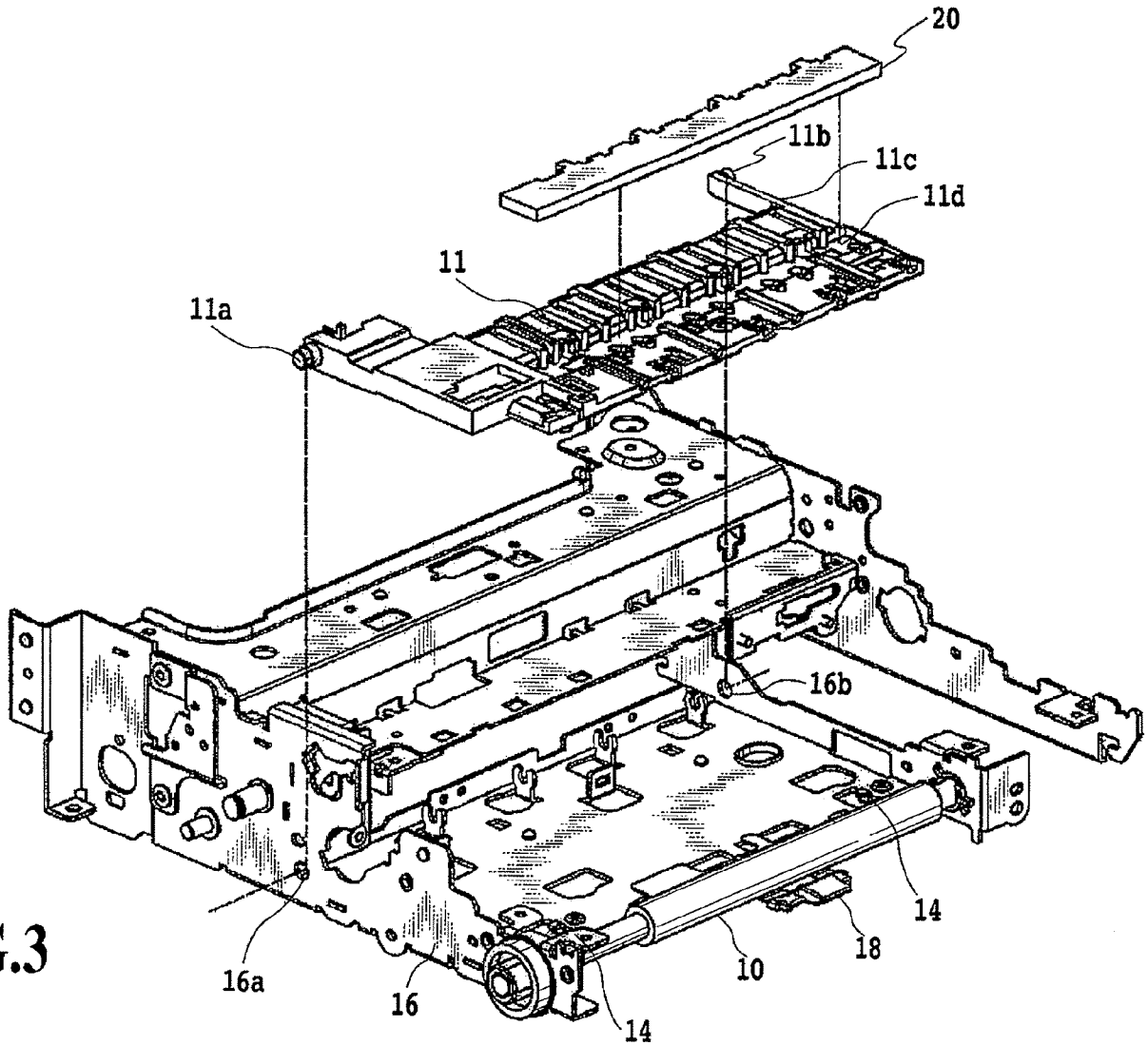
FIG. 3 is a perspective view showing how a platen is mounted.

FIG. 2 is a perspective view showing a print medium eject unit and its associated parts, and FIG. 3 is a perspective view showing a platen 11, that restricts the attitude of the print medium, being mounted in the chassis 16. The platen 11, as described later, is pivotally supported at two locations on the chassis 16 and has a plurality of eject guides 17 rotatably mounted thereon to guide the print medium from the platen 11 to a nip portion between the eject roller 10 and the eject pinch rollers 12.

As shown in FIG. 3, the platen 11 is formed with shaft portions 11*a*, 11*b* inserted in and pivotally supported by support holes 16*a*, 16*b* of the chassis 16. The platen 11 has an integrally formed, elastically deformable portion 11*c* that can be deformed elastically when the shaft portion 11*b* of the platen 11 is inserted into the support hole 16*b* of the chassis 16.

The platen 11 is formed of a resin material such as ABS (acrylonitrile-butadiene-styrene). Its elastically deformable portion 11*c* measures about 2 mm thick by about 7 mm wide by about 20 mm long. When the platen 11 is assembled into the chassis 16, the elastically deformable portion 11*c* is temporarily deformed elastically to allow the shaft portion 11*b* of the platen 11 to be inserted into the support hole 16*b* of the chassis 16. Then, the elastically deformable portion 11*c* is released from the elastic deformation. Now, the platen 11 can pivot about the shaft portions 11*a*, 11*b*.

The platen 11 is also provided with a recessed portion 11*d* at a position facing the print head moving area. In this recessed portion 11*d* is installed an ink absorbing member 20 that recovers ink that has landed outside outer edges of the print medium during a marginless printing. The ink absorbing member 20 is formed of, for example, a porous material having a sufficient absorbing ability.

The printing apparatus can produce a printed result with no blank portions at the outer edges of the print medium by also printing those areas slightly overrunning the outer edges of the print medium. The overrunning distance from the outer edges of the print medium is set at approximately 1-5 mm, considering size errors of the print medium when it is cut and a transport precision of the platen 11.

Figure 4:
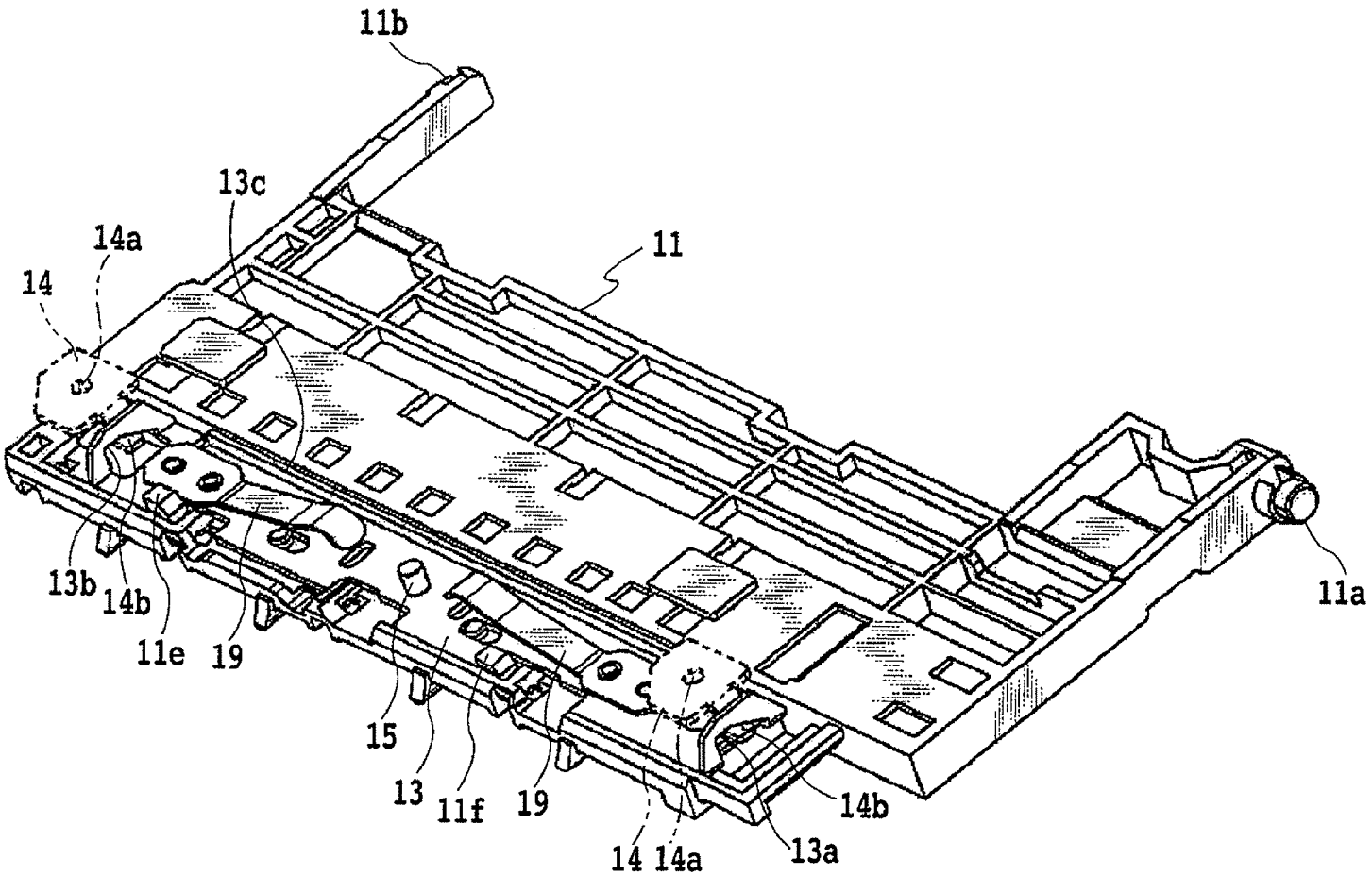
FIG. 4 is a perspective view showing a back side of the platen.

FIG. 4 is a perspective view showing the back side of the platen 11. On the back side of the platen 11 is provided a pivot restriction member 13 that restricts the pivotal motion of the shaft portions 11*a*, 11*b*. The pivot restriction member 13 has catch portions 13*a*, 13*b* at its ends. The chassis 16 is fitted with positioning members 14 that engage the catch portions 13*a*, 13*b* of the pivot restriction member 13 to determine the position of the platen 11. The platen 11 pivots to a first position when the catch portions 13*a*, 13*b* engage the positioning members 14 mounted on the chassis 16. The platen 11 pivots to a second position when the catch portions 13*a*, 13*b* part from the positioning members 14.

In the manufacturing process at a factory, the paper-print head distance can be set to a desired value by pivoting the positioning members 14 about a pivotal center 14*a* to change the position at which engagement portions 14*b* engage the catch portions 13*a*, 13*b* of the pivot restriction member 13.

The pivot restriction member 13 is integrally fitted with leaf springs 19 as by caulking. The leaf springs 19 are formed into a size, for example, 4 mm wide and 20 mm long, with its front end bent and rounded. The leaf springs 19 are formed of stainless steel for spring and, after being bent, undergoes a low-temperature annealing to remove residual stresses caused by the machining work.

A general molding process of plastic parts involves heating a resin material to a high temperature to melt it, pouring the molten resin under pressure into a mold, cooling it to solidify, and then taking the molded product out of the mold. The resin material shrinks 0.1-1% during the process of cooling and solidifying. So, if a molded product is not uniform in shape and thickness, the shrinkage may become ununiform, causing distortions such as warping.

The platen of this embodiment is shaped like a flat plate and thus, when molded, easily warps. To prevent this, the pivot restriction member 13 is formed almost uniform in width along the length of the platen 11 and integrally mounted to the platen 11 by means of a screw 15 and engagement claws 11*e*, 11*f*. Further, the pivot restriction member 13 has a bent portion 13*c* extending in the lengthwise direction thereof. The bent portion 13*c* increases a section modulus of the platen 11 and therefore its mechanical strength, also serving as a reinforcement of the platen 11.

Further, as described above, integrally mounting the pivot restriction member 13 to the platen 11 can correct the warping of the platen 11 by a bias force of the pivot restriction member 13 even if the platen 11 is molded. The integral mounting of the pivot restriction member 13 also eliminates the need for the platen 11 itself to increase its mechanical strength, allowing for a reduction in the thickness of the platen 11. As a result, the mechanical strength of the platen 11 can be secured without increasing the number of parts. This in turn leads to a reduction in size and weight of the printing apparatus as a whole and also to a reduction in manufacturing cost.

Next, a method of adjusting a distance between a print medium and the print head by pivoting the platen 11 to the first and second position will be explained by referring to the perspective view of FIG. 5.

Figure 5:
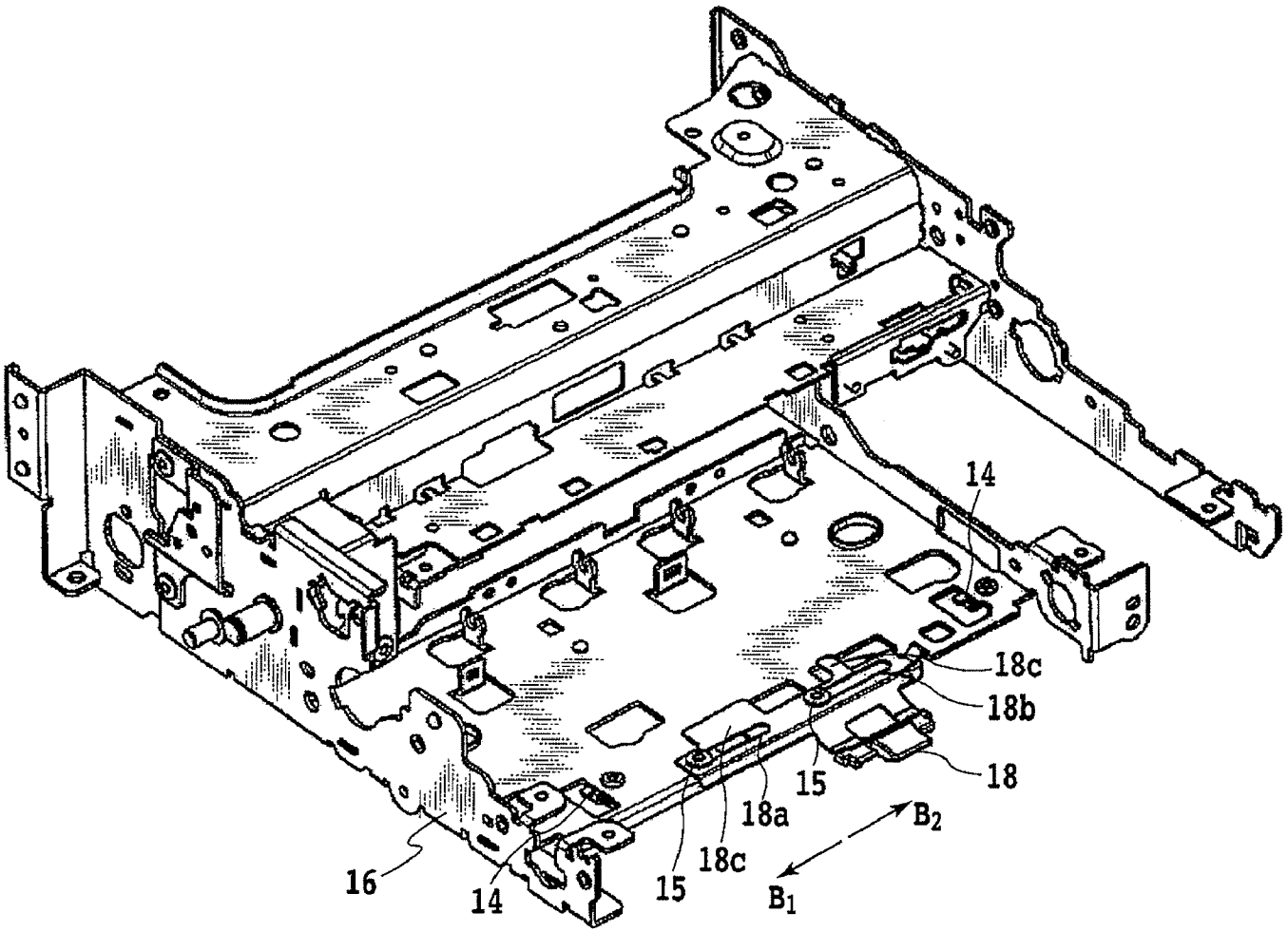
FIG. 5 is a perspective view showing a chassis of the printing apparatus of this embodiment.

FIG. 5 is a perspective view of a chassis 16 of the printing apparatus of this embodiment.

The print head sends ink droplets flying onto a print surface of the print medium and therefore performs the printing operation with the print head out of contact with the print medium. The ink droplets slow down by air resistance as they fly toward the print medium, and thus their flying directions may become unstable. Therefore the distance between the print head and the print medium is preferably set as small as possible and normally set in a range of between 0.5 mm and 1.5 mm.

A variety of kinds of print mediums is used, ranging from relatively thin mediums, such as plain paper, to relatively thick mediums such as envelopes. When a relatively thick print medium is used, it is expected that the print head may come in contact with the print medium. To prevent such contact, a provision is made to allow a distance between the platen and the print head to be set arbitrarily by a user according to the condition of use. Two methods are available for adjusting the distance between the platen 11 (see FIG. 2) and the print head: one that moves the carriage and one that moves the platen 11. This embodiment employs the method which moves the platen 11. In the following explanation, the distance between the print medium guided along the platen 11 and the print head is called a "paper gap."

The chassis 16 has a paper gap adjust lever 18 slidably mounted thereon. The paper gap adjust lever 18 is formed with elongate slots 18*a*, 18*b* extending one in each direction of arrows B1, B2. These slots 18*a*, 18*b* are wide enough to receive bosses (not shown) of the chassis 16. The paper gap adjust lever 18 is guided in the directions of arrows B1, B2 relative to the chassis 16, with the bosses of the chassis 16 engaged in the slots 18*a*, 18*b*.

The bosses (not shown) of the chassis 16 are formed with a threaded hole, in which the paper gap adjust lever 18 is fitted so that there is a gap between the top of the bosses of the chassis 16 and the upper surface of the paper gap adjust lever 18 to prevent the screw 15 from fastening the paper gap adjust lever 18. The paper gap adjust lever 18 also has a flat plate portion 18*c* on which the leaf springs 19 integrally fitted to the pivot restriction member 13 rides.

(Paper Gap Adjustment Unit)

An operation of the platen 11 as performed by the paper gap adjust lever 18 will be explained in detail by referring to detailed views of the printing apparatus shown in FIG. 6, FIG. 7, FIG. 8 and FIG. 9.

Figure 6:
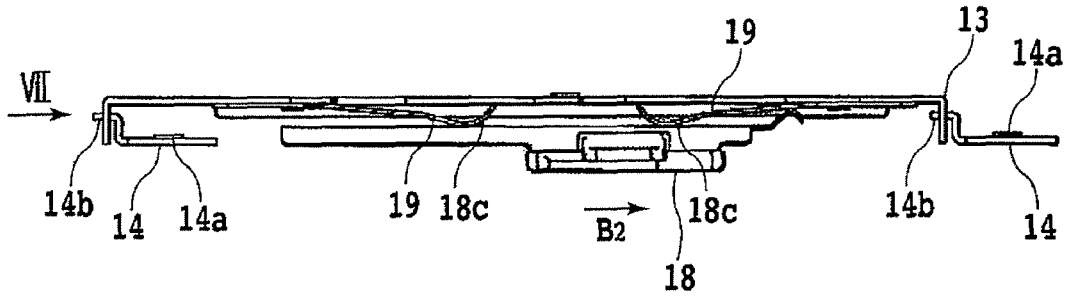
FIG. 6 is a front view showing a part of the chassis when a paper gap (paper-print head distance) is set small.
Figure 7:
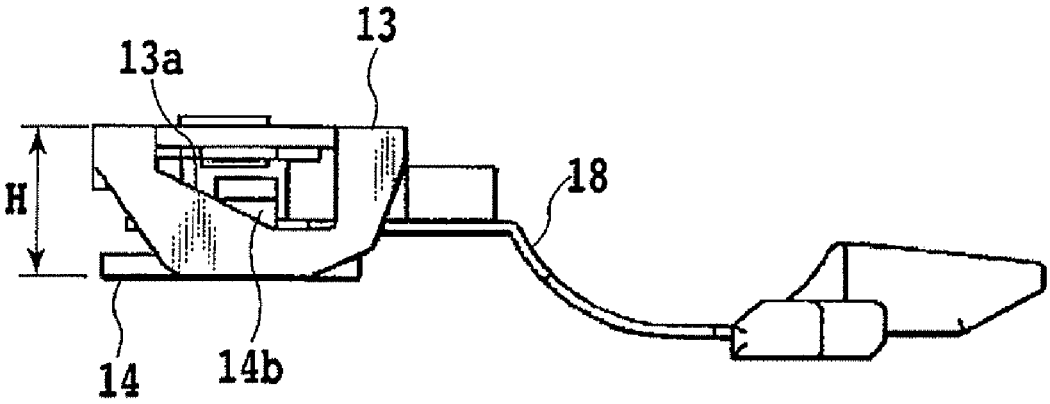
FIG. 7 is a side view showing a part of the chassis when a paper gap is set small.

FIG. 6 and FIG. 7 are explanatory views of the paper gap adjustment unit with the paper gap set small. FIG. 6 shows a view as seen from the front of the printing apparatus and FIG. 7 a view as seen from an arrow direction VII of FIG. 6. In this state, the paper gap adjust lever 18 is shown to have been operated in the direction of arrow B2, with the flat plate portion 18*c* elastically deforming and compressing the leaf spring 19 attached to the pivot restriction member 13. The leaf spring 19 pushes up the platen 11 by its own bias force to cause the platen 11 to pivot about the shaft portions 11*a*, 11*b*.

As the platen 11 pivots, the catch portion 13*a* and the opposite catch portion 13*b* of the pivot restriction member 13 engage the engagement portions 14*b* of the positioning members 14 mounted on the chassis 16. As a result, the pivot restriction member 13 is situated at a raised position H with respect to the positioning members 14 on the chassis 16. At this time, the platen 11 stops pivoting at the first position that reduces the paper gap.

The bias force of the leaf spring 19 is set large enough to pivot the platen 11 against a total resisting force including a weight of the platen 11, a weight of the pivot restriction member 13, a weight of the leaf spring 19, a weight of the print medium guided by the platen 11, a reaction produced by an elasticity of the print medium, a weight of the ink absorbing member 20 for marginless printing and a weight of the ink absorbed.

Figure 8:
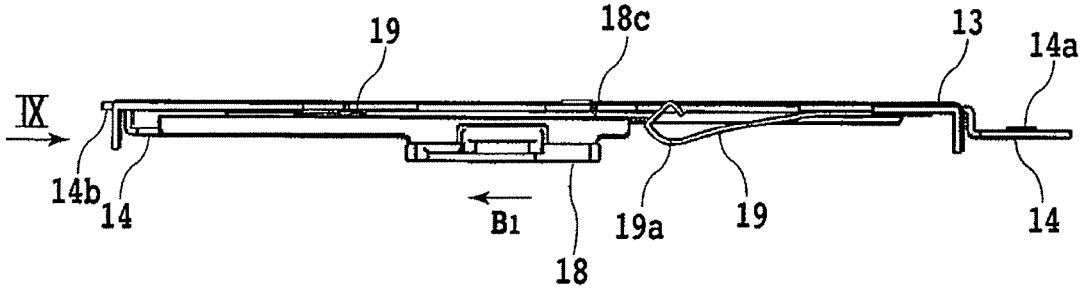
FIG. 8 is a front view showing a part of the chassis when a paper gap (paper-print head distance) is set large.
Figure 9:
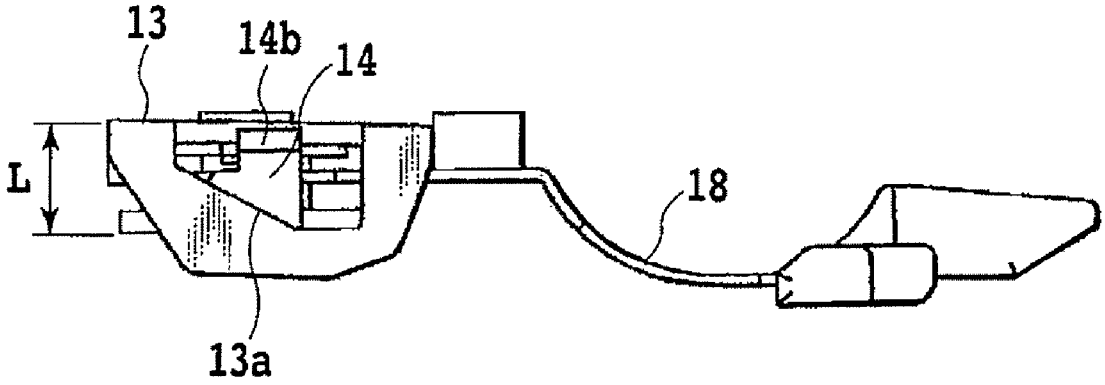
FIG. 9 is a side view showing a part of the chassis when a paper gap is set large.

FIG. 8 and FIG. 9 show the paper gap adjustment unit with the paper gap set large. As the paper gap adjust lever 18 is driven in the direction of arrow B1 in FIG. 8, the flat plate portion 18*c* is moved from just under the rounded bent portion 19*a* of the leaf spring 19. The platen 11 loses the bias force of the leaf spring 19 that was pushing up the platen, so it pivots downward about the shaft portions 11*a*, 11*b*, causing a stopper portion (not shown) to engage the chassis 16. As a result, the pivot restriction member 13 assumes a low position L with respect to the positioning members 14 on the chassis 16. The platen 11 therefore is stopped at the second position that separates the print medium greatly from the print head, setting a large paper gap.

(Eject Guide)

Next, the eject guides 17 will be explained by referring to FIG. 10, FIG. 11 and FIG. 12.

Figure 10:
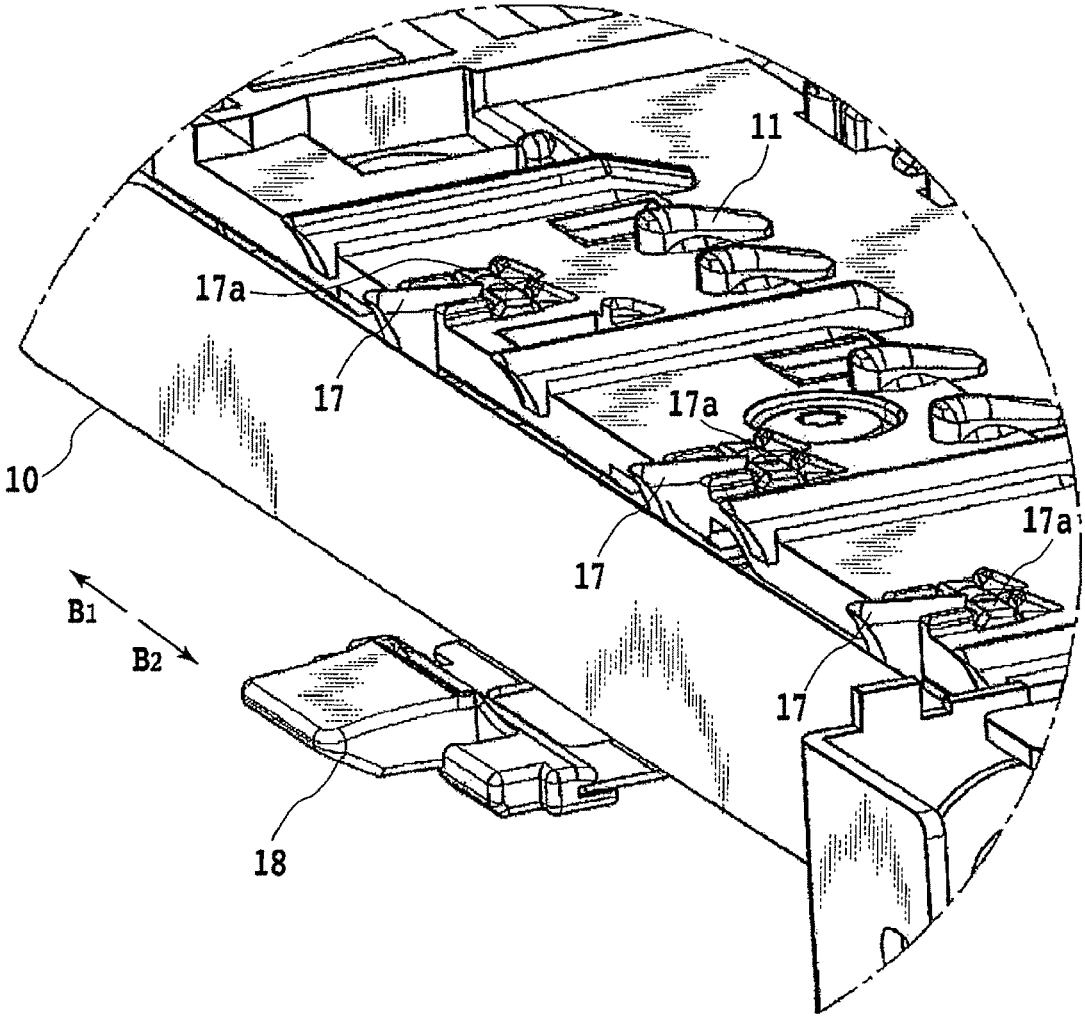
FIG. 10 shows the platen and its associated parts.

FIG. 10 is a perspective view showing the platen 11 and its associated parts; FIG. 11 is a cross-sectional view of the platen with the paper gap set small; and FIG. 12 is a cross-sectional view of the platen with the paper gap set large. As shown in FIG. 10, the eject roller 10 is coated with urethane-based elastomer or urethane coating, or is formed of a material with a relatively high friction coefficient, such as sponge. The eject roller 10, like the transport roller 8 (see FIG. 1), may be applied with a coating containing ceramic particles on its outer circumferential surface that transports the print medium.

The eject guides 17 are formed of a resin material such as POM (polyoxymethylene) and at one end have a pivot axis portion 17*a* pivotally supported on the platen 11. Each of the eject guides 17 also has an engagement portion 17*b* for the platen 11 and an engagement portion 17*c* for the chassis 16. Each eject guide 17 pivots downward by its own weight and then its pivotal motion about an axis of the pivot axis portion 17*a* is restricted by the engagement portion 17*b* engaging with the platen 11 or by the engagement portion 17*c* engaging with the chassis 16. That is, the eject guides 17 engage the platen 11 or chassis 16 to guide a print medium as described later, whatever paper gap adjustment is made.

Next, the operation of the eject guides 17 will be explained. As shown in FIG. 11, with the paper gap set small, the eject guide 17 is supported by the platen 11 engaging the engagement portion 17*b*. In this state, the eject guide 17 guides the print medium, that has been transported from the platen 11, to the nip portion between the eject pinch roller 12 and the eject roller 10.

Figure 11:
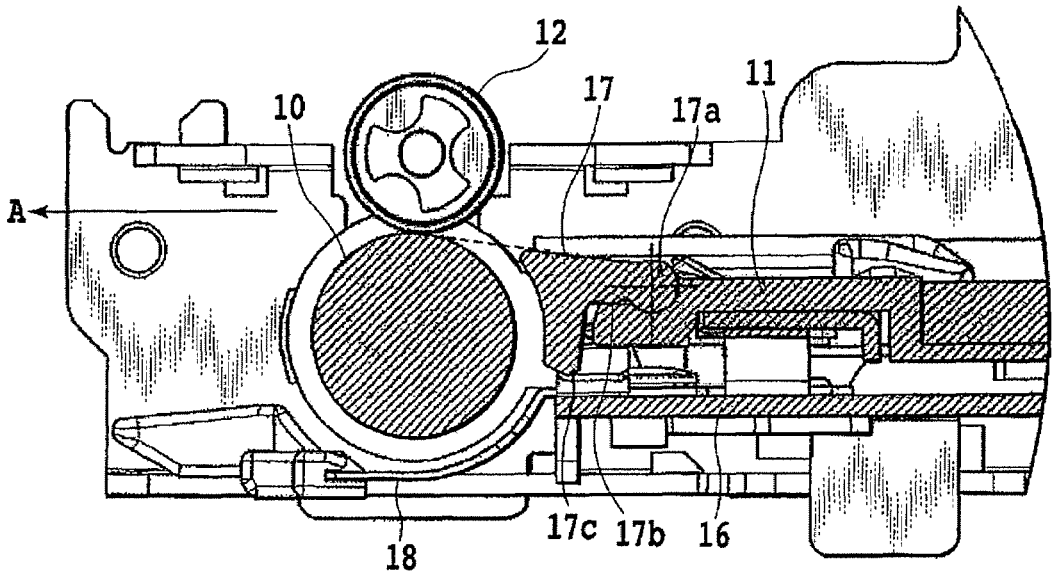
FIG. 11 is a cross-sectional view showing the platen and its associated parts with the paper gap set small.
Figure 12:
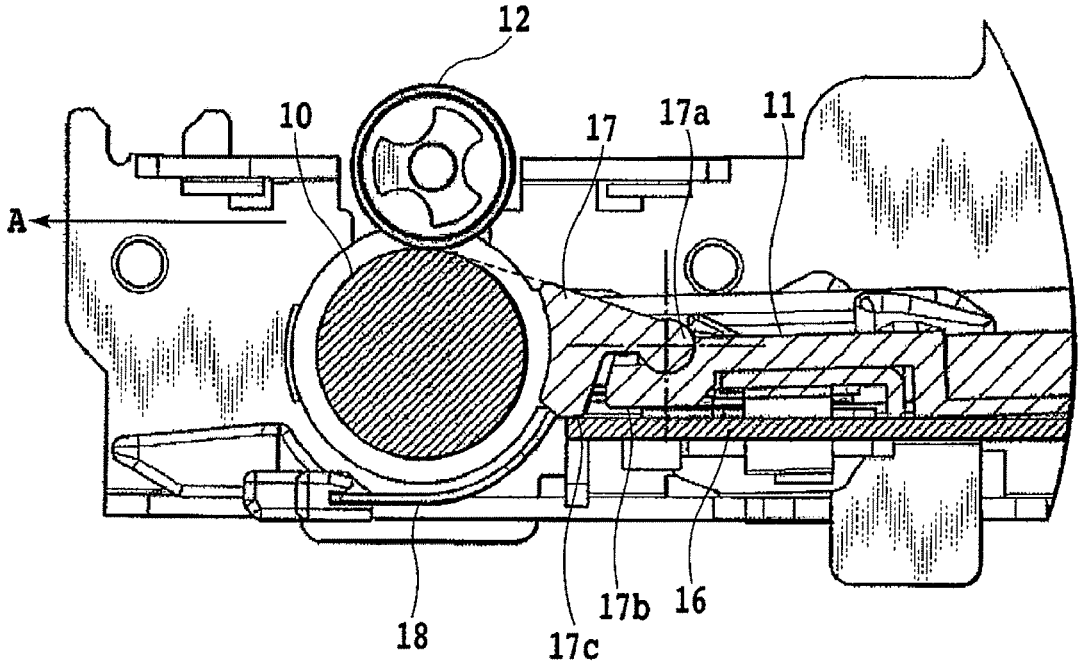
FIG. 12 is a cross-sectional view showing the platen and its associated parts with the paper gap set large.

When the paper gap is set large, the eject guide changes its state from FIG. 11 to that of FIG. 12. The platen 11 pivots downward about the shaft portions 11*a*, 11*b* (see FIG. 4) by its own weight until a stopper portion (not shown) of the platen 11 engages the chassis 16 at a predetermined position, at which time the platen 11 stops. As the platen 11 pivots, the eject guide 17 has its pivot axis portion 17*a* move down and its engagement portion 17*c* land on the chassis 16. As a result, the eject guide 17 is pivoted clockwise in the figure about the pivot axis portion 17*a* and held there. In this state, the eject guide 17 can still guide the print medium, that has been transported from the platen 11, to the nip portion between the eject pinch roller 12 and the eject roller 10.

For the print medium to be guided precisely to the nip portion between the eject pinch roller 12 and the eject roller 10, it is important to enhance the precision of the positions of the eject roller 10 and the eject guide 17. Particularly when the paper gap is set large, the platen 11 supporting the print medium during printing tilts downward, so the positional accuracy of the eject guide 17 is important. If the positional accuracy is bad, there is a possibility of the print medium striking against the eject roller 10. In the construction of this embodiment, the eject roller 10 is supported on the chassis 16 and the positions of the platen 11 and the eject guide 17 are also determined by the chassis 16. It is therefore possible to guide the print medium to the nip portion of the eject pinch roller 12 and the eject roller 10 with high precision.

Further, in this embodiment a plurality of eject guides 17 are arranged to guide a plurality of portions of the front end of a fixed size print medium (including the left and right side ends) to the nip portion of the eject pinch roller 12 and the eject roller 10. These eject guides 17 may be connected together as one unit but, considering the flatness of the platen 11, it is desired that the individual eject guides 17 be operated independently of each other.

As described above, guiding the print medium by the eject guides 17 can eliminate so-called printing irregularities caused by the print medium striking against the eject roller 10 and thus allow for a highly precise printing operation. Therefore, with this printing apparatus, the print medium can be transported to the eject roller 10 side easily and reliably by the eject guides 17 of relatively simple construction.

The printing apparatus according to this invention is suitably applied to a printing apparatus requiring a paper gap adjustment, particularly to one that makes the paper gap adjustment by moving the platen.

Although this embodiment has shown an example case where the eject roller 10 has a uniform diameter, this invention is not limited to this and may be applied to an eject roller having a plurality of different diameters.

Second Embodiment

In the following, a second embodiment of this invention will be described in detail by referring to the accompanying drawings. The second embodiment is almost similar in construction to the first embodiment, except that the method of determining the positions of the eject guides 17 and the platen 11 differs from that of the first embodiment.

The first embodiment, when the paper gap is set large, performs with high precision the guiding of the print medium to the nip portion between the eject pinch rollers 12 and the eject roller 10 by positioning the platen 11, eject guides 17 and eject roller 10 by the chassis 16.

Figure 13:
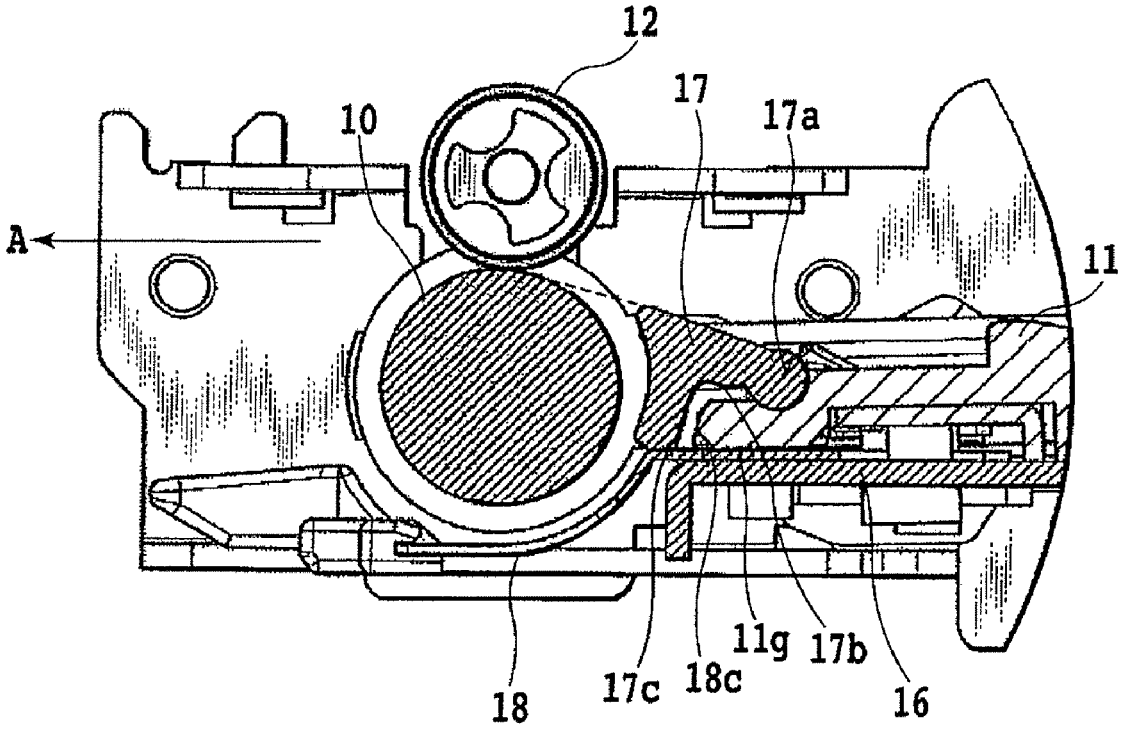
FIG. 13 is a cross-sectional view showing a platen and its associated parts in a printing apparatus of a second embodiment, with a paper gap set large.

FIG. 13 is a partial cross-sectional view of a printing apparatus of the second embodiment of this invention when the paper gap is set large. In this embodiment, when the paper gap is set large, the platen 11 pivots downward by its own weight about the shaft portions 11*a*, 11*b* (see FIG. 2) until a lever engagement portion 11*g* comes into contact with the flat plate portion 18*c* of the paper gap adjust lever 18, at which time the platen stops. As the platen 11 rotates, the pivot axis portion 17*a* of the eject guide 17 moves down causing the engagement portion 17*c* to land on the flat plate portion 18*c* of the paper gap adjust lever 18. The eject guide 17 therefore pivots about the pivot axis portion 17*a* on the platen 11. In this state also, the eject guide 17 is so constructed as to be able to guide a print medium to the nip portion between the eject pinch rollers 12 and the eject roller 10. In this way, the positions of the platen 11 and the eject guides 17 when the paper gap is set large may be determined by the flat plate portion 18*c* of the paper gap adjust lever 18.

Third Embodiment

Figure 14:
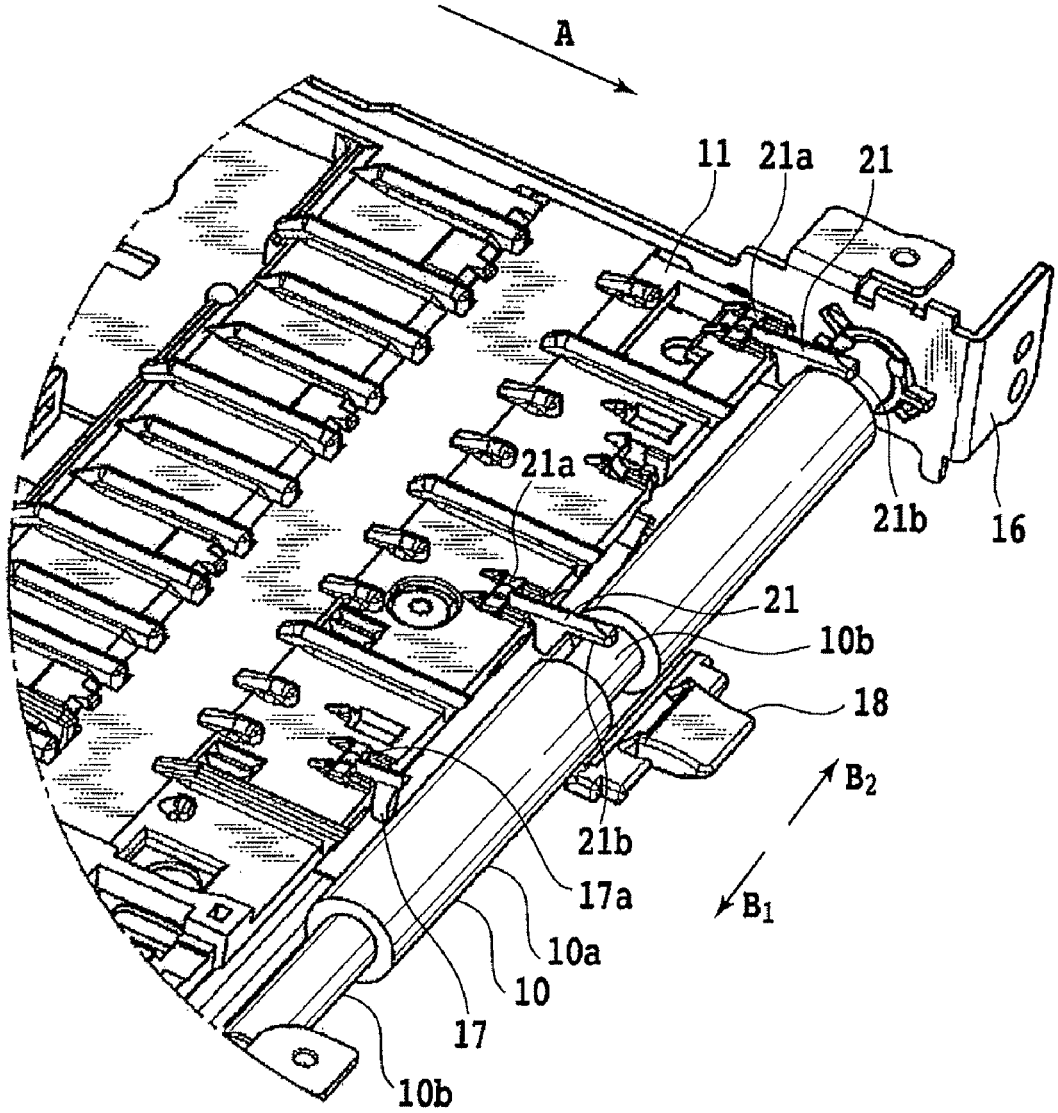
FIG. 14 is a perspective view showing an eject unit in a printing apparatus of a third embodiment.
Figure 15:
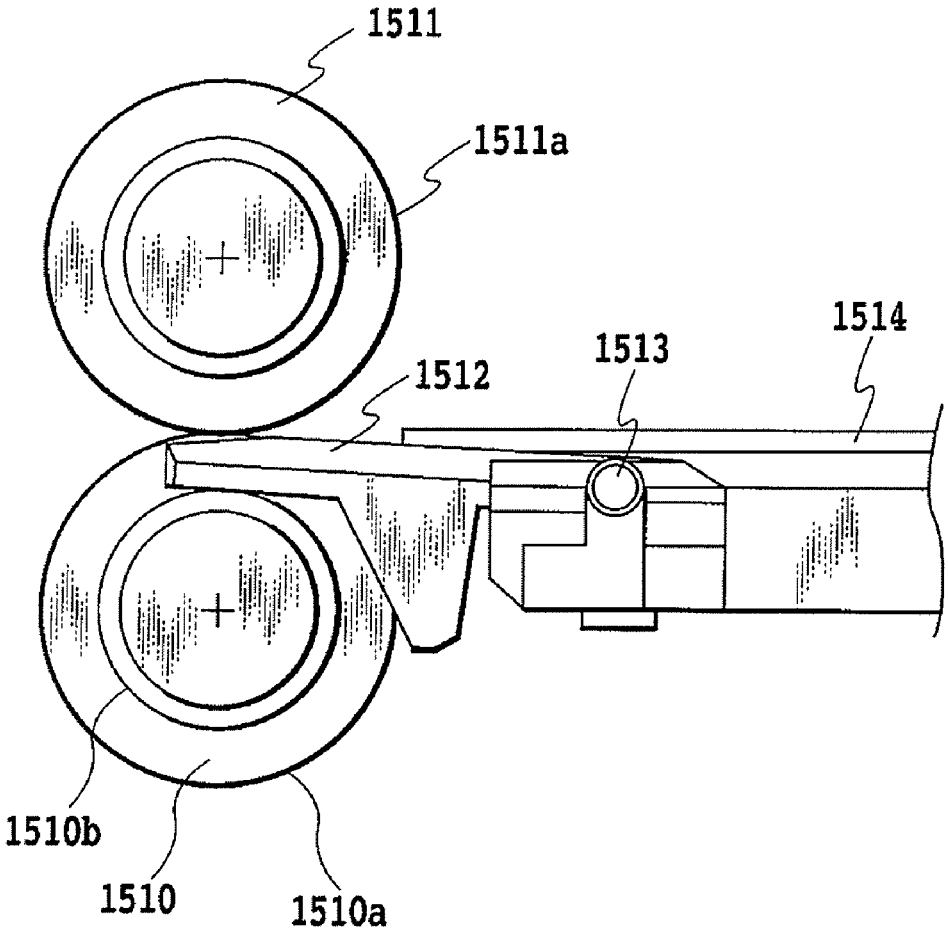
FIG. 15 illustrates a relation between a conventional eject guide and a pair of rollers.

FIG. 14 is a perspective view showing an eject unit of the printing apparatus of this embodiment.

While in the first and second embodiment, the eject roller 10 is uniform in diameter, the eject roller 10 of this embodiment has small second roller portions 10*b* one at each side of a first roller portion 10*a*. The construction of this embodiment combines the eject guide of the patent document 1 with the eject guide 17 of the first and second embodiment described earlier.

The eject guide of the patent document 1 is so arranged that one of its ends contacts the second roller portions 10*b* on both sides of the eject roller 10. However, if the first roller portion 10*a* is a longitudinally elongate eject roller, the interval between the eject guides is large making it impossible to guide satisfactorily an intermediate part of the print medium between the eject guides. To avoid this, this embodiment installs another eject guide 17 at an intermediate position between the second roller portions 10*b* to enable a satisfactory guiding of the print medium.

In FIG. 14 the eject roller 10 has a plurality of first roller portions 10*a* and second roller portions 10*b*, the second roller portions 10 being smaller in diameter than the first roller portions 10*a*.

The second roller portions 10*b* are outer circumferential surfaces of metal rotating shafts coated with nickel plating. The second roller portions 10*b* constitute "low friction portions" with their friction coefficients set lower than those of the first roller portions 10*a*. The first roller portions 10*a* are formed of an elastic material such as rubber and fitted to an outer circumferential portion of the rotating shaft. The first roller portions 10*a* constitute "high friction portions" with their friction coefficients set higher than those of the second roller portions 10*b*. Among the rubber materials to form the first roller portions 10*a*, EPDM (ethylene-propylene trimer) may be used with a rubber hardness preferably set at 50-90°. The first roller portions 10*a* may be coated with urethane-based elastomer or urethane coating or formed of materials with relatively high friction coefficients, such as sponge.

The eject guides 17, 21 are formed of a resin material such as POM (polyoxymethylene) and have, at one end in the print medium transport direction, pivot axis portions 17*a*, 21*a* integrally formed therewith that are pivotally supported on the platen 11. The eject guide 17 is provided with an engagement portion 17*b* for the platen 11 and an engagement portion 17*c* for the chassis 16. The eject guide 21 has an engagement portion 21*b* that engages an outer circumferential surface of the second roller portions 10*b* of the eject roller 10. The eject guide 17 is restricted in its pivotal motion about the pivot axis portion 17*a* by the engagement portions 17*b*, 17*c* engaging, by their own weight, the platen 11 and the chassis 16 respectively. The eject guide 21 is restricted in its pivotal motion about the pivot axis portion 17*a* by the engagement portion 21*b* engaging, by its own weight, the outer circumferential surface of the second roller portions 10*b* of the eject roller 10. (For the eject guides 17, their operation is similar to that of the first and second embodiment.)

The eject guide 17 is arranged on the upstream side, in the print medium transport direction, of a plurality of the first roller portions 10*a* of the eject roller 10. The eject guide 21 is arranged in a print medium passage area at both axial ends of a plurality of the first roller portions 10*a*.

Next, the operation of the eject guides 17, 21 will be explained. In a state where the paper gap is set small, the eject guide 17 has its engagement portion 17*b* in contact with the platen 11. The eject guide 21 has its engagement portion 21*b* in contact with the outer circumference of the second roller portions 10*b* of the eject roller 10. In this state, the eject guides 17, 21 guide a print medium to a nip portion between the eject pinch rollers 12 and the first roller portions 10*a* of the eject roller 10.

When the paper gap is set large, the platen 11 pivots downward by its own weight about the shaft portions 11*a*, 11*b* (see FIG. 2) until the stopper portion (not shown) abuts against the chassis 16, at which time the platen 11 stops. As the platen 11 pivots, the pivot axis portion 17*a* of the eject guide 17 moves down, causing the engagement portion 17*c* to land on the chassis 16. Then, the eject guide 17 pivots about the pivot axis portion 17*a* on the platen 11. In this state also, the eject guide 17 guides a print medium to the nip portion between the eject pinch rollers 12 and the first roller portions 10*a* of the eject roller 10.

As for the eject guide 21, as the platen 11 pivots, the pivot axis portion 17*a* moves down. The engagement portion 21*b* engages the second roller portions 10*b* of the eject roller 10. In this state also, the eject guide 21 guides a print medium to the nip portion between the eject pinch rollers 12 and the first roller portions 10*a* of the eject roller 10.

Although the printing apparatus in the above embodiments have been described to be of the serial type, this invention may also be applied to a full line type printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-227181, filed Aug. 23, 2006, which is hereby incorporated by reference herein in its entirety.

What is claimed is:

1. A printing apparatus comprising:

a platen to guide a print medium to a position facing a print head, said platen pivotably attached to a chassis and movable between a first position and a second position that is further away from said print head than the first position;

an eject roller held at a predetermined position on said chassis to eject the printed print medium; and an eject guide to guide the print medium from the platen toward the eject roller, said eject guide pivotally supported on the platen;

wherein when said platen exists at the first position, said eject guide is located in contact with said platen, and wherein when said platen exists at the second position, said eject guide is located in contact with the chassis.

2. A printing apparatus according to claim 1, wherein the eject guide is provided with an engagement portion for engaging the platen.

3. A printing apparatus according to claim 1, wherein the eject roller contacts the print medium along its fixed outer diameter.

4. A printing apparatus according to claim 1, wherein the eject roller has a small-diameter portion and a large-diameter portion.

5. A printing apparatus according to claim 4, wherein a second eject guide is pivotally supported on the platen;

wherein the second eject guide has an engagement portion for engagement with the small-diameter portion of the eject roller;

wherein the second eject guide pivots as the platen moves.

6. The printing apparatus according to claim 1, further comprising:

a carriage to mount print head, and a guide shaft that guides a movement of said carriage and be supported by said chassis.

* * * * *